US008808555B2

(12) United States Patent
Watanabe et al.

(10) Patent No.: US 8,808,555 B2
(45) Date of Patent: Aug. 19, 2014

(54) METHOD OF MANUFACTURING SUBSTRATE FOR LIQUID DISCHARGE HEAD

(75) Inventors: Keiji Watanabe, Oita (JP); Shuji Koyama, Kawasaki (JP); Hiroyuki Abo, Tokyo (JP); Keiji Matsumoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 53 days.

(21) Appl. No.: 13/379,192

(22) PCT Filed: Jul. 29, 2010

(86) PCT No.: PCT/JP2010/063234

§ 371 (c)(1),
(2), (4) Date: Dec. 19, 2011

(87) PCT Pub. No.: WO2011/027645

PCT Pub. Date: Mar. 10, 2011

(65) Prior Publication Data

US 2012/0097637 A1 Apr. 26, 2012

(30) Foreign Application Priority Data

Sep. 2, 2009 (JP) ..... 2009-202735

(51) Int. Cl.

| | |
|---|---|
| ***B41J 2/16*** | (2006.01) |
| ***B44C 1/22*** | (2006.01) |
| ***B41J 2/14*** | (2006.01) |

(52) U.S. Cl.

CPC ..... *B41J 2/1404* (2013.01); *B41J 2/1634* (2013.01); *B41J 2/1629* (2013.01); *B41J 2/1603* (2013.01); *B41J 2/1639* (2013.01); *B41J 2/14145* (2013.01)

USPC ..... 216/27; 216/41; 216/83; 438/745; 438/733; 438/734

(58) Field of Classification Search

CPC .... B41J 2/1404; B41J 2/14145; B41J 2/1626; B41J 2/1628; B41J 2/1629

USPC ..... 216/27, 41, 83; 438/745, 733, 734

See application file for complete search history.

(56) References Cited

U.S. PATENT DOCUMENTS

| | | | | |
|---|---|---|---|---|
| 6,397,466 | B1 | 6/2002 | Koyama et al. | |
| 6,677,237 | B2 * | 1/2004 | Umetsu et al. | 438/667 |

(Continued)

FOREIGN PATENT DOCUMENTS

| | | | |
|---|---|---|---|
| CN | 1515413 | A | 7/2004 |
| CN | 101380847 | A | 3/2009 |
| JP | H1095119 | A | 4/1998 |

OTHER PUBLICATIONS

Chinese Office Action issued in counterpart application No. 201080034835.9 dated Nov. 20, 2013, along with its English-language translation—26 pages.

*Primary Examiner* — Shamim Ahmed

(74) *Attorney, Agent, or Firm* — Fitzpatrick, Cella, Harper & Scinto

(57) ABSTRACT

Provided is a method of manufacturing a substrate for a liquid discharge head including a first face, energy generating elements which generate the energy to be used to discharge a liquid to a second face opposite to the first face, and liquid supply ports for supplying the liquid to the energy generating elements. The method includes preparing a silicon substrate having, at the first face, an etching mask layer having an opening corresponding to a portion where the liquid supply ports are to be formed, and having first recesses provided within the opening, and second recesses provided in the region of the second face where the liquid supply ports are to be formed, the first recesses and the second recesses being separated from each other by a portion of the substrate; and etching the silicon substrate by crystal anisotropic etching from the opening of the first face to form the liquid supply ports.

14 Claims, 5 Drawing Sheets

(56) References Cited

U.S. PATENT DOCUMENTS

| | | | |
|---|---|---|---|
| 6,979,797 | B2 | 12/2005 | Rivas et al. |
| 7,063,799 | B2 | 6/2006 | Hayakawa et al. |
| 7,727,411 | B2 | 6/2010 | Yamamuro et al. |
| 7,753,495 | B2 | 7/2010 | Hayakawa et al. |
| 7,824,560 | B2 | 11/2010 | Sakai et al. |
| 8,057,017 | B2 | 11/2011 | Sakai et al. |
| 8,366,950 | B2 | 2/2013 | Chida et al. |
| 2004/0174407 | A1 | 9/2004 | Hayakawa et al. |
| 2006/0191862 | A1 | 8/2006 | Hayakawa et al. |
| 2007/0212890 | A1 | 9/2007 | Sakai et al. |
| 2009/0065474 | A1 | 3/2009 | Chida et al. |
| 2009/0065481 | A1 | 3/2009 | Kishimoto et al. |
| 2010/0216264 | A1 | 8/2010 | Matsumoto et al. |
| 2012/0058578 | A1 | 3/2012 | Yonemoto et al. |

* cited by examiner

METHOD OF MANUFACTURING SUBSTRATE FOR LIQUID DISCHARGE HEAD

TECHNICAL FIELD

The present invention relates to a method of manufacturing a substrate for a liquid discharge head used for a liquid discharge head. Specifically, the present invention relates to a method of manufacturing a substrate used for an ink-jet recording head which injects a liquid, such as ink, toward a recording medium.

Background Art

Conventionally, a liquid discharge head (hereinafter referred to a side shooter type head) of a type in which a liquid is discharged from an upper portion of a liquid discharge pressure generating element has been known. In this type of liquid discharge head, a system is adopted which provides through ports (liquid supply ports) in a substrate in which discharge energy generating portions are formed, and of supplying the liquid from the rear face of the face where the discharge energy generating portions are formed.

A method of performing drilling using a laser on an Si material (silicon substrate) having plane orientation <100> to form recesses, and then performing anisotropic etching is disclosed in US Patent Application Laid-Open No. 2007/0212890. This Si anisotropic etching method performs hole drilling on the Si material in advance to shorten the etching time until formation of liquid supply ports, and performs the control of the opening width depending on the positions of the recesses.

Additionally, U.S. Pat. No. 6,979,797 discloses a method of manufacturing a liquid discharge head by performing cutting work on the surface of the Si material with a laser, and penetrating the material by wet etching or laser processing from the rear face.

In a manufacturing method of forming these processing sections, there is an advantage that it is possible to further miniaturize an element substrate of a liquid discharge head. That is, there is an advantage that it is possible to make the width of the element substrate narrow. Particularly, in a head in which a plurality of liquid supply ports is provided in one element substrate, such as a recording head for color ink discharge, further miniaturization of such an element substrate is required.

However, in the method disclosed in US Patent Application Laid-Open No. 2007/0212890, when the recesses are formed with a laser, there are concerns that tip bending may occur due to lack of output or variation of depth may occur. Therefore, the depth of the recesses is limited, and prolonged etching time is needed.

On the other hand, in the method disclosed in U.S. Pat. No. 6,979,797, processing area is large, and therefore, a long processing time is required. For this reason, there is a problem in that production efficiency is bad. Additionally, since an area where cutting work is required, there are concerns that it is difficult to cope with further miniaturization of an element substrate.

CITATION LIST

Patent Literature

PTL 1: US Patent Application Laid-Open No. 2007/0212890

PTL 2: U.S. Pat. No. 6,979,797

SUMMARY OF INVENTION

Technical Problem

Thus, the invention aims at providing a method of manufacturing a substrate for a liquid discharge head capable of stably manufacturing a substrate for a liquid discharge head with high production efficiency. Specifically, the invention aims at manufacturing a substrate for a liquid discharge head having supply ports with a smaller opening width than in the past with high precision in a short time.

Solution to Problem

In order to attain the above-mentioned object, provided is a method of manufacturing a substrate for a liquid discharge head including a first face, energy generating elements which generate the energy to be used to discharge a liquid to a second face opposite to the first face, and liquid supply ports for supplying the liquid to the energy generating elements. The method includes preparing a silicon substrate having, at the first face, an etching mask layer having an opening corresponding to a portion where the liquid supply ports are to be formed, and having first recesses provided within the opening, and second recesses provided in the region of the second face where the liquid supply ports are to be formed, the first recesses and the second recesses being separated from each other by a portion of the substrate; and etching the silicon substrate by crystal anisotropic etching from the opening of the first face to form the liquid supply ports.

According to one example of the invention, it is possible to manufacturing a substrate for a liquid discharge head having supply ports with a reduced opening width with high productive efficiency stably.

DESCRIPTION OF EMBODIMENTS

Hereinafter, exemplary embodiments of the invention will be described with reference to the drawings.

The feature of a method of manufacturing a substrate for a liquid discharge head of the invention is that anisotropic etching is carried out after recesses (hereinafter also described as "leading holes") are formed in both faces of a silicon substrate, for example, by laser processing. Both the faces of the silicon substrate which form the recesses indicate two faces including a face (hereinafter referred to as a first face) which forms an etching mask layer, as a face in which the anisotropic etching for forming the liquid supply ports is started, and a face (hereinafter referred to as a second face) opposite to this face. In a case where etching is performed toward the front face of the silicon substrate on which liquid discharge energy generating elements are to be arranged from the rear face of the silicon substrate and the liquid supply ports are formed, the rear face of the silicon substrate becomes the first face, and the front face of the silicon substrate becomes the second face. In the following respective embodiments, this will be described in detail.

First Embodiment

Figure 1:
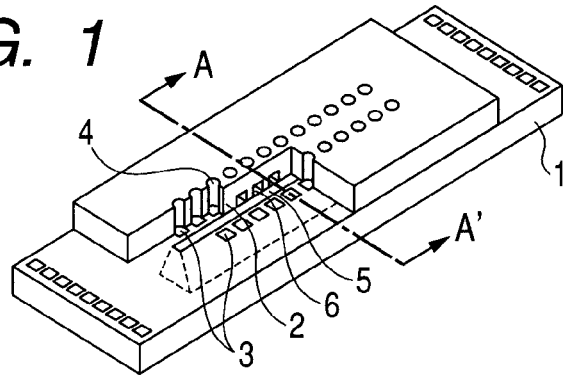
FIG. 1 is a perspective view illustrating a portion of a liquid discharge head of an embodiment of the invention.

A portion of the liquid discharge head of one embodiment of the invention is shown in FIG. 1.

This liquid discharge head has a silicon substrate 1 in which two rows of liquid discharge energy generating elements (hereinafter referred to as energy generating elements) 3 are aligned and formed at predetermined pitches. On the silicon substrate 1, liquid discharge ports 4, which are opened above a flow passage side wall 2 and the energy generating elements 3, are formed from a coating photosensitive resin which forms a flow passage forming member. Upper portions of flow passages 6 which communicate with the liquid discharge ports 4 through the flow passages 6 from the liquid supply ports 5 are formed by this flow passage forming member. Additionally, the liquid supply ports 5 formed by the anisotropic etching of silicon are opened between two rows of the liquid discharge energy generating elements 3. This liquid discharge head applies the energy generated by an energy generating element 3 to a liquid which has been filled into a flow passage 6 via an ink supply port 5, thereby making liquid droplets be discharged from a liquid discharge port 4 and adhere to a recording medium, thereby performing recording.

It is possible to load this liquid discharge head on apparatuses, such as a printer, a copying machine, a facsimile having a communication system, and a word processor having a printer unit, and industrial recording apparatuses complexly combined with various processing apparatuses. Then, it is possible to perform recording on various recording mediums, such as paper, threads, fibers, leather, metal, plastic, glass, timber, and ceramic by using this liquid discharge head. In addition, in the invention, the "recording" refers to not only transferring images with meaning, such as characters or figures to a recording medium, but also transferring images with no meaning, such as patterns.

(Feature of Anisotropic Etching Using Leading Holes)

Figure 2A:
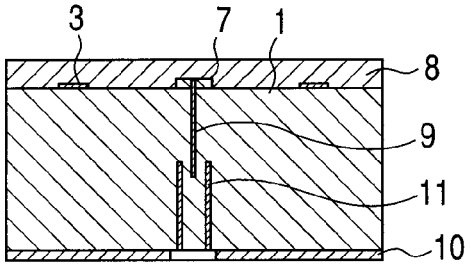
FIGS. 2A, 2B, 2C, 2D, and 2E are sectional views of a substrate for a liquid discharge head to which a manufacturing method of a first embodiment of the invention is applied.
Figure 2B:
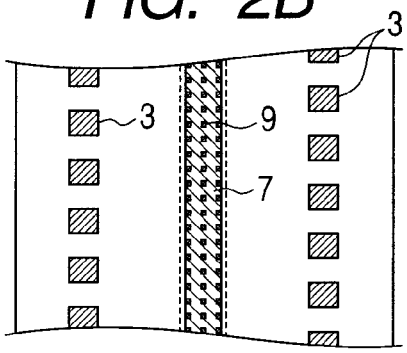
Figure 2C:
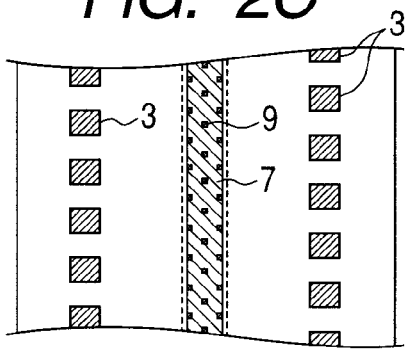

A section in the manufacturing process of a substrate for a liquid discharge head to which a manufacturing method of this embodiment is applied is shown in FIG. 2A, and top views in the manufacturing process of a substrate for a liquid discharge head to which the manufacturing method of this embodiment is applied are shown in FIGS. 2B to 2C. In addition, FIG. 2A shows a section when a liquid discharge head substrate is cut by a plane vertical to the substrate through the line A-A' in FIG. 1. An etching mask layer 10 which has an opening corresponding to a portion where the liquid supply ports are to be formed is formed on the rear face (first face) of the silicon substrate 1.

Figure 2D:
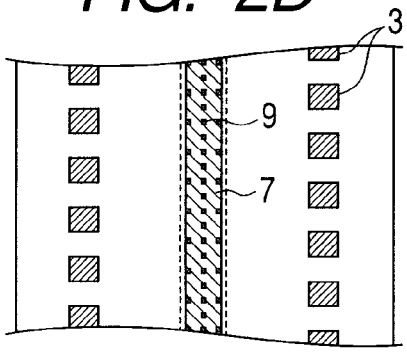
Figure 2E:
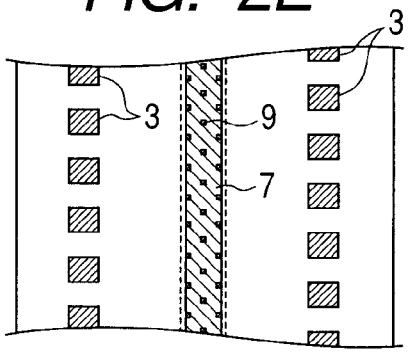

According to the manufacturing method of this embodiment, crystal anisotropic etching is performed from the opening of the first face to form the liquid supply ports in the silicon substrate, in a state where recesses are formed in the portion on the second face where the liquid supply ports to be formed, and the recesses are formed on the opening of the first face. In one aspect of such an embodiment, two rows of leading holes 11 are formed in a desired pattern with a desired depth on the rear face of the silicon substrate 1 in the longitudinal direction of the opening by laser processing in a state where a sacrificial layer 7 is provided on the silicon substrate 1. Additionally, one row of leading holes 9 are formed in a desired pattern with a desired depth in a longitudinal direction of the opening in the face opposite to the rear face of the silicon substrate 1. Here, the direction of the rows when expressed by two rows (one row) of leading holes being formed in the longitudinal direction of the opening indicates the orientation in which each row is arrayed along the longitudinal direction of the opening, and leading holes equivalent to the number of rows are included in a section in a lateral direction of the opening which has the leading holes. The two or more rows of leading holes 11 and the one row of leading holes 9 are arranged at predetermined pitches, as shown in FIGS. 2B to 2D. Thereafter, it is possible to form an etching stop layer (passivation layer) 8, and to carry out the anisotropic etching, thereby easily and stably forming the liquid supply ports 5 which have a face vertical to the face of the silicon substrate 1.

The sacrificial layer 7 is provided in a region where the liquid supply ports 5 in the front face of the silicon substrate 1 after etching are to be formed. The sacrificial layer 7 is effective but is not indispensable to the invention when attempting to mark out a formation area of the liquid supply ports with high precision. The sacrificial layer is formed from a material whose etching rate is faster than silicon. For example, in a case where etching is made by an alkali solution, it is possible to use aluminum, aluminum silicone, aluminum bronze, aluminum silicone copper, etc.

In the present embodiment, it is possible to take the aspect shown in FIG. 2A as a case where the leading holes 9 and the leading holes 11 overlap each other in the thickness direction of the silicon substrate 1. In this aspect, the leading holes 9 of the front face of the silicon substrate 1 are formed in at least one row in the longitudinal direction of the liquid supply ports 5 in the region at the front face of the substrate for a liquid discharge head where the liquid supply ports 5 are to be formed. Preferably, the leading holes 9 are formed on the centerline (this line passes through the center in the lateral direction) of the liquid supply ports 5, as seen in the longitudinal direction of the liquid supply ports 5, in the region of the substrate for a liquid discharge head where the liquid supply ports 5 are to be formed. In addition, in the disclosed embodiment, the leading holes 9 are arrayed and formed in one row, and may be formed in two or more rows. In a case where the leading holes are formed in two or more rows, it is preferable to provide the leading holes so that they are symmetrically arranged with respect to the centerline of the liquid supply ports. For example, if the leading holes are formed in three rows, it is possible to arrange one row of leading holes on the centerline of the liquid supply ports, and it is possible to arrange the two remaining rows of leading holes symmetrically with respect to the centerline.

The etching stop layer 8 is formed from a material with resistance against a material used for the anisotropic etching. As the etching stop layer, it is possible to use an inorganic film of oxidation silicon, silicon nitride, or the like capable of being removed by dry etching or the like. Additionally, it is also possible to use an organic film capable of being removed by chemical processing or the like. Since formation of the opening is performed by starting the anisotropic etching from the first face, and making the etching reach the second face, it is possible to arrange the etching stop layer 8 on the leading holes 9 (on the recesses) formed in the second face. The sacrificial layer 7 and the etching stop layer 8 just have to be formed on the silicon substrate 1 in cases where the sacrificial layer and the etching stop layer are used independently or used together at a stage before etching is performed. At a stage before etching, formation timing or order is arbitrary, and the method just has to be based on well-known methods. Additionally, a passivation layer which has etching resistance may be formed so as to cover the sacrificial layer.

Next, as one aspect in the case the leading holes 9 and the leading holes 11 overlap each other in the thickness direction of the silicon substrate 1, the leading holes 11 of the rear face of the silicon substrate 1 are formed in at least two rows in the longitudinal direction of the liquid supply ports 5 in the region at the rear face of the substrate for a liquid discharge head where the liquid supply ports 5 are to be formed. Preferably, the leading holes 11 are formed while making rows symmetrical with respect to the centerline of the liquid supply ports, as seen in the longitudinal direction of the liquid supply ports 5, in the region of the substrate for a liquid discharge head where the liquid supply ports 5 are to be formed. In addition, in the disclosed embodiment, the leading holes 11 are arrayed and formed in two rows, and may be formed in three or more rows.

Additionally, the leading holes 11 of the rear face (first face) of the silicon substrate 1 may be formed in one row as another aspect in the case the leading holes 9 and the leading holes 11 overlap each other in the thickness direction of the silicon substrate 1. In this case, the leading holes 9 of the front face (second face) of the silicon substrate 1 are formed in at least one row in the longitudinal direction of the liquid supply ports 5 in the region of the front face of the substrate for a liquid discharge head where the liquid supply ports 5 are to be formed. In this aspect, it is preferable to form the leading holes 9 and the leading holes 11 so as to satisfy the relationship of $X+Y \geq T$, where T is defined as the thickness (μm) of the silicon substrate 1, X is defined as the depth (μm) of the leading holes 9, and Y is defined as the depth (μm) of the leading holes 11.

More preferably, $X+Y>T$ is satisfied.

Additionally, it is preferable that the leading holes 9 and the leading holes 11 be formed on the same section in a lateral section of the silicon substrate.

The process of etching when the crystal anisotropic etching has been performed on the silicon substrate 1 in which the leading holes 9 at the front face of the silicon substrate 1 shown in FIGS. 2A to 2E and the leading holes 11 at the rear face of the silicon substrate 1 are formed is schematically shown in FIG. 3. In the following example, an example in which the sacrificial layer 7 and the etching stop layer 8 are used is shown.

Figure 3A:
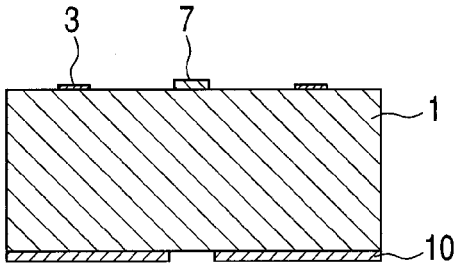
FIGS. 3A, 3B, 3C, 3D, 3E, 3F, 3G, and 3H are views illustrating a method of manufacturing the substrate for a liquid discharge head related to the first embodiment of the invention.
Figure 3B:
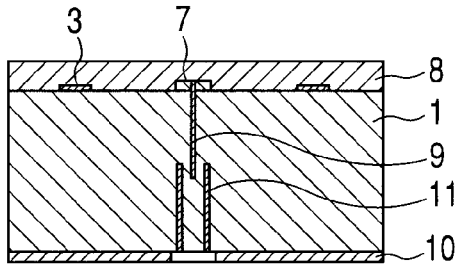
Figure 3C:
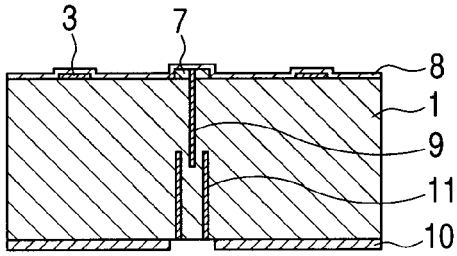
Figure 3D:
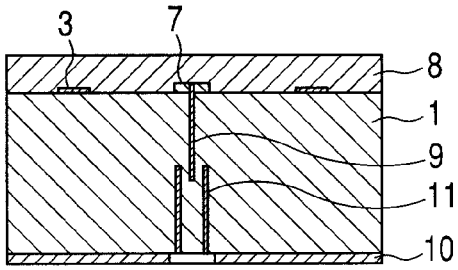

As shown in FIG. 3A, the energy generating elements 3 and the sacrificial layer 7 are formed on the silicon substrate 1, and the etching mask 10 is formed on the face opposite to the front face of the silicon substrate 1. Thereafter, as shown in FIG. 3B, one row of the leading holes 9 and two rows of the leading holes 11 are formed, and the etching stop layer 8 of an organic film may be formed. At this time, as shown in FIG. 3C, the etching stop layer of an inorganic film may be formed. Additionally, as shown in FIG. 3D, in a state where the etching stop inorganic film is formed on the sacrificial layer 7 and the energy generating elements 3, one row of the leading holes 9 and two rows of the leading holes 11 may be formed, and the organic film etching stop layer 8 may be formed. Additionally, after the sacrificial layer 7 is formed, it is possible to form the leading holes 9 with a laser so as to pass through the sacrificial layer 7. Additionally, the inorganic film etching stop layer 8 of an may be formed somewhat thinly on the sacrificial layer 7, and the leading holes 11 may be formed with a laser so as to pass through the sacrificial layer 7 and the etching stop layer 8.

Figure 3E:
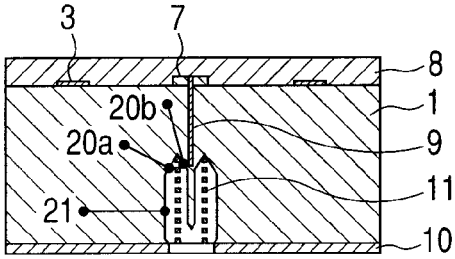

Then, <111> planes 20*a* and 20*b* are formed so as to become narrower in the direction toward the front face of the silicon substrate 1 from the tip of each of the leading holes 11 at the rear face of the silicon substrate 1 by the anisotropic etching. Simultaneously, etching proceeds in the direction (horizontal direction of the drawing) perpendicular to the thickness direction of the silicon substrate 1 from the insides of the leading holes 11. Additionally, in the opening at the face which forms the etching mask 10 of the silicon substrate 1, <111> planes 21 are formed so as to become wider in the direction toward the front face of the silicon substrate 1 (FIG. 3E). When etching proceeds further, the <111> planes 20*b* formed between two leading holes 11 from the respective leading holes 11 touch each other. Then, etching proceeds further toward the front face of the silicon substrate 1 from an apex formed by these <111> planes 20*b* (FIG. 3F).

Figure 3F:
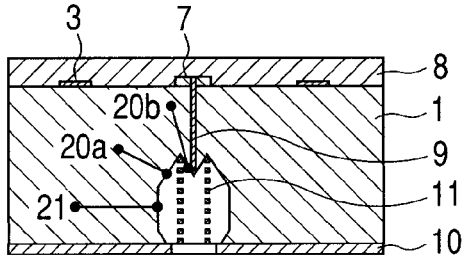
Figure 3G:
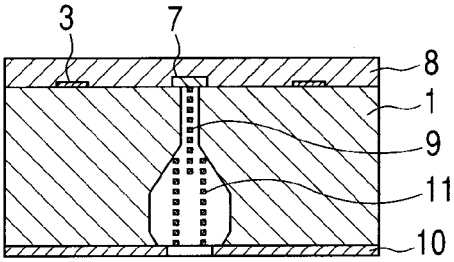
Figure 3H:
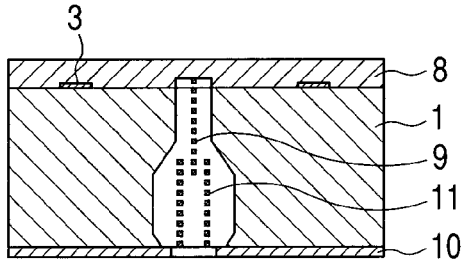

When etching proceeds further from FIG. 3F, the apex formed by the <111> planes 20*b* communicate with the leading holes 9 of the face with the energy generating elements 3, and the sacrificial layer 7 comes into contact with an etching solution and is etched (FIG. 3G). Then, the sacrificial layer 7 is completely etched, and becomes as is shown in FIG. 3H. In addition, it is also possible to perform etching in a state where there is no sacrificial layer 7.

Figure 4:
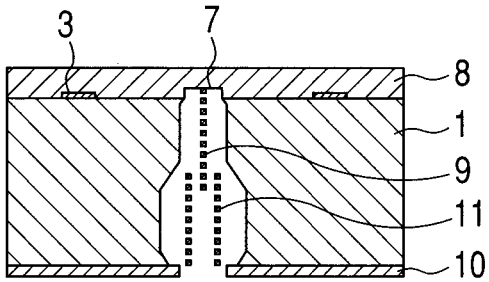
FIG. 4 is a sectional view of the substrate for a liquid discharge head in the case when over etching is performed in the first embodiment of the invention.

As shown in FIG. 4, an opening surface at the sacrificial layer 7 of the liquid supply ports 5 may become larger than a region where the liquid supply ports 5 are to be formed or a region where the sacrificial layer 7 is provided. It may be considered that this results from over etching or the like. However, this does not have a significant influence on supply characteristics.

In the forming method of liquid supply ports 5 as described above, the formation positions of the <111> planes 20*a* which are formed so that processing width becomes narrow in the direction toward the front face of the silicon substrate 1 are determined depending on the positions of the leading holes 9 of the front face of the silicon substrate 1, and the leading holes 11 of the rear face of the silicon substrate 1. Additionally, the formation positions of the <111> planes 21 formed from the opening at the rear face of the silicon substrate 1 are determined by the opening position of the etching mask 10 arranged at the rear face of the silicon substrate 1.

Figure 5A:
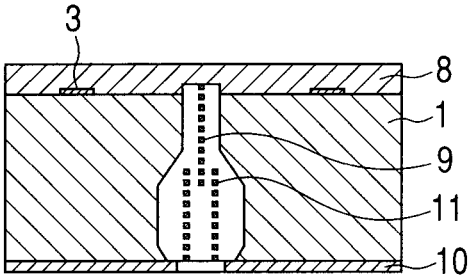
FIGS. 5A and 5B are sectional views of the substrate for a liquid discharge head when an arrangement pattern of leading holes is replaced in the first embodiment of the invention.
Figure 5B:
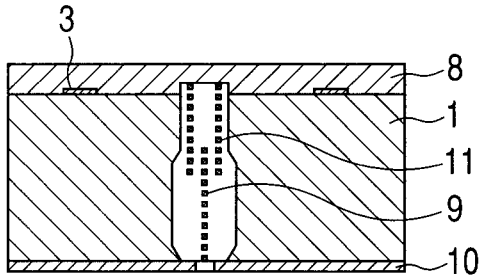

Additionally, as shown in FIG. 5B, the leading holes 9 in the front face of the silicon substrate 1 and the leading holes 11 in the rear face of the silicon substrate 1, which are shown in FIG. 5A, may be arranged in reverse. In the case of FIG. 5B, the leading holes 11 of the front face of the silicon substrate 1 are formed in at least two rows in the longitudinal direction of the liquid supply ports 5 in the region of the front face of the substrate for a liquid discharge head where the liquid supply ports 5 are to be formed. Preferably, the leading holes 11 are formed while making rows symmetrical with respect to the centerline of the liquid supply ports, as seen in the longitudinal direction of the liquid supply ports 5, in the region of the substrate for a liquid discharge head where the liquid supply ports 5 are to be formed. In addition, three or more rows of the leading holes 11 may be formed. On the other hand, the leading holes 9 of the rear face of the silicon substrate 1 are formed in at least one row in the longitudinal direction of the liquid supply ports 5 in the region (opening) of the rear face of the substrate for a liquid discharge head where the liquid supply ports 5 are formed. Preferably, the leading holes 9 are formed on the centerline (this line passes through the center in the lateral direction) of the liquid supply ports 5, as seen in the longitudinal direction of the liquid supply ports 5, in the region of the substrate for a liquid discharge head where the liquid supply ports 5 are to be formed. In addition, two or more rows of the leading holes 9 may be formed. In a case where the leading holes are formed in two or more rows, it is preferable to provide the leading holes so that they are symmetrically arranged with respect to the centerline of the liquid supply ports. Additionally, it is preferable to form the leading holes 9 and the leading holes 11 so as to satisfy the relationship of $$X+Y \geq T$$

where T is defined as the thickness (μm) of the silicon substrate 1, X is defined as the depth (μm) of the leading holes 9, and Y is defined as the depth (μm) of the leading holes 11.

Additionally, it is preferable that the leading holes 9 and the leading holes 11 be formed so as to exist on the same section in a lateral section of the silicon substrate. In the progression of the etching as described above, it is also possible to adopt a second embodiment (which will be described later) in which the leading holes 9 and the leading holes 11 do not overlap each other in the thickness direction of the silicon substrate 1, in the aspect where at least one row of the leading holes 9 are provided, and at least two rows of the leading holes 11 are provided. In this aspect, the depth of the leading holes 11 and the leading holes 9 is able to have the relationship below. T is defined as the thickness of the silicon substrate 1, X is defined as the depth of the leading holes 11 formed in two rows, Y is defined as the depth of the leading holes 9 formed in one row, and Z is defined as the distance between the rows of the leading holes 11 formed in two rows. Then, it is preferable that the depth X of the leading holes 11 formed in two rows and the depth Y of the leading holes 9 formed in one row fall within the following range in order to make the anisotropic etching proceed from the rear face of the silicon substrate 1 and make a region to be etched reach the sacrificial layer 7.

$$X+Y+Z/2 \tan 54.7° \geq T$$

Figure 6:
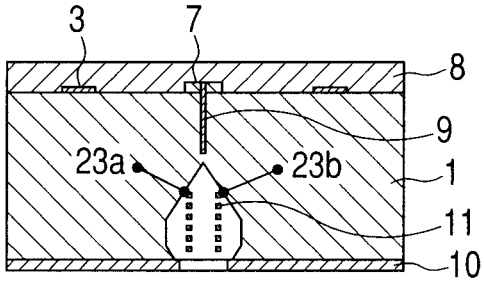
FIG. 6 is a sectional view of a substrate for a liquid discharge head in a case where leading holes do not communicate with each other.

Here, a sectional view in a case where the above expression is not satisfied when the leading holes 11 are formed in the longitudinal direction of the liquid supply ports 5 is shown in FIG. 6. In this case, the anisotropic etching does not appear to proceed at the apex of two <111> planes 23*a* and 23*b* formed at the tips of the leading holes 11, and it may be difficult to expose the sacrificial layer 7.

Figure 7A:
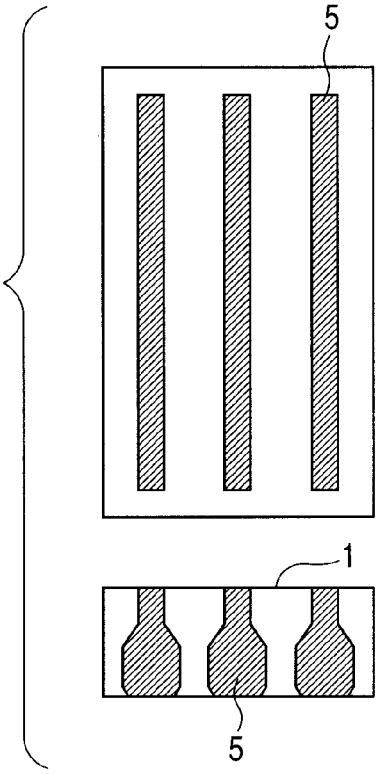
FIGS. 7A and 7B are views illustrating a formation pattern of liquid supply ports of the invention.

Additionally, in the method of manufacturing a substrate for a liquid discharge head described above, the liquid supply ports 5 are formed in a state where the liquid supply ports communicate with each other in the longitudinal direction of the silicon substrate 1 (FIG. 7A). In addition, in the disclosed embodiment, the energy generating elements 3, the sacrificial layer 7, and the etching stop layer 8 are omitted. In the present embodiment, although processing has been performed using a laser beam of a third harmonic wave (THG: wavelength of 355 nm) of a YAG laser, laser beams capable of being used for processing are not limited to this if the laser beam has a wavelength capable of performing hole drilling on silicon which is a material for the silicon substrate 1. For example, a second harmonic wave (SHG: wavelength of 532 nm) of a YAG laser as well as THG has a high absorption factor with regard to silicon, and hole drilling may be performed using this.

Figure 7B:
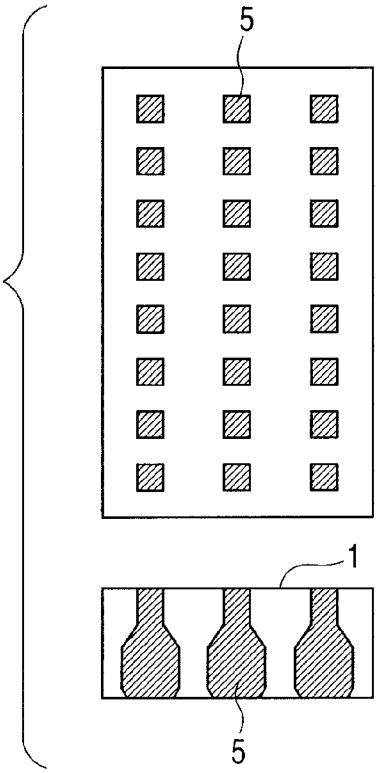

Additionally, the method of manufacturing the substrate for a liquid discharge head of the invention is able to process the liquid supply ports easily and independently (FIG. 7B) compared with FIG. 7A since it is possible to make the opening width narrower than in the past. A substrate for a liquid discharge head manufactured using this processing has high rigidity and has a merit that the flatness of wafers is maintained.

Second Embodiment

Next, the process of etching in the case the leading holes 9 of the front face of the silicon substrate 1 and the leading holes 11 of the rear face of the silicon substrate 1 do not overlap each other in the thickness direction of the silicon substrate 1 is shown in FIGS. 8A to 8H. In addition, in the following description, the steps of forming flow passages and discharge ports on a substrate are illustrated together.

Figure 8A:
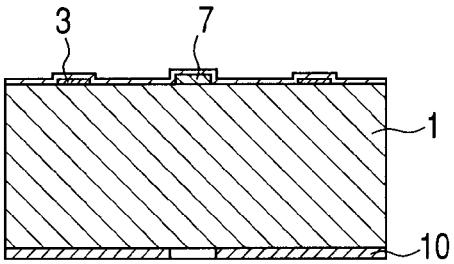
FIGS. 8A, 8B, 8C, 8D, 8E, 8F, 8G, and 8H are views illustrating a method of manufacturing a substrate for a liquid discharge head related to a second embodiment of the invention.
Figure 8B:
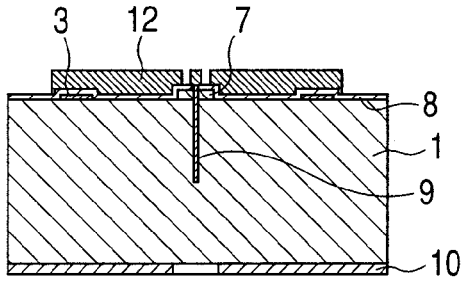
Figure 8C:
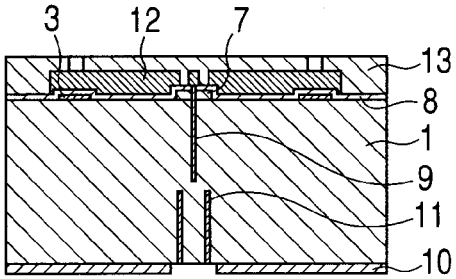

As shown in FIG. 8A, the energy generating elements 8 and the sacrificial layer 7 are formed on the silicon substrate 1, and the etching mask 10 is formed on the face opposite to the front face of the silicon substrate 1. Thereafter, as shown in FIG. 8B, one row of the leading holes 9 are formed at pitches of 100 μm in the longitudinal direction of the opening of the front face, and the etching stop layer 12 of an organic film is patterned. As a specific example of the material, polymethylisopropenylketone (ODUR-1010 made by Tokyo Ohka Kogyo Co., Ltd.) is exemplified. As also shown in FIG. 8C, a nozzle material 13 which forms a flow passage side wall is formed and patterned on the etching stop layer 12 of an organic film. A composition A composed of the following is exemplified as a specific example of the material.

Composition A

- Epoxy resin; EHPE3150 (made by Daicel Chemical Industries Ltd.); 94 parts by weight
- Silane coupling agent; A-187 (made by Nippon Unicar Company Limited); 4 parts by weight
- Photo-acid-generating agent; SP-172 (made by Adeka Corporation); 2 parts by weight Thereafter, two rows of the leading holes 11 are formed at a pitch of 100 μm between two rows, and at pitches of 100 μm in the longitudinal direction of the opening of the rear face, in the rear face of the silicon substrate 1. At this time, the one row of leading holes 9 and the two rows of leading holes 11 are laser-processed with a depth of 390 μm.

Figure 8D:
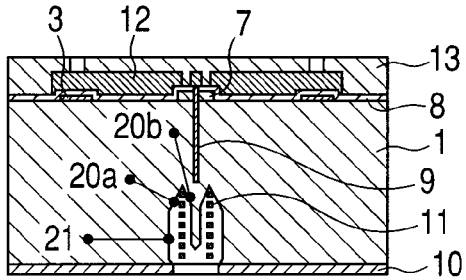

Next, anisotropic etching is performed. Etching is performed where the etching conditions are such that the concentration of tetramethylammonium hydroxide (TMAH) is 22% and liquid temperature is 80° C. In addition, as for the etching solution, the concentration, and the liquid temperature, even conditions other than those shown above are possible. Then, <111> planes 20*a* and 20*b* are formed so that width becomes narrow in the direction toward the front face of the silicon substrate 1 from the tip of each of the leading holes 11 at the rear face of the silicon substrate. Simultaneously, etching proceeds in the direction (horizontal direction of the drawing) perpendicular to the thickness direction of the silicon substrate 1 from the insides of the leading holes 11. Additionally, in the opening at the rear face of the silicon substrate 1, <111> planes 21 are formed so as to grow wider in the direction toward the front face of the silicon substrate 1 (FIG. 8D).

When etching further proceeds, the <111> planes 20*b* formed between two leading holes 11 from the respective leading holes 11 touch each other. Then, etching further proceeds toward the front face of the silicon substrate 1 from an apex formed by these <111> planes 20*b* (FIG. 8E).

Figure 8E:
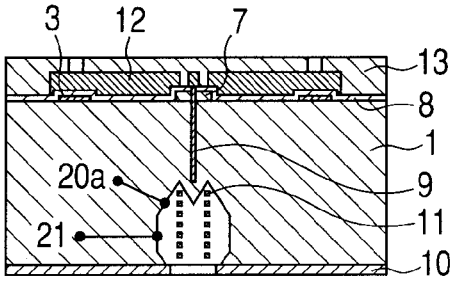
Figure 8F:
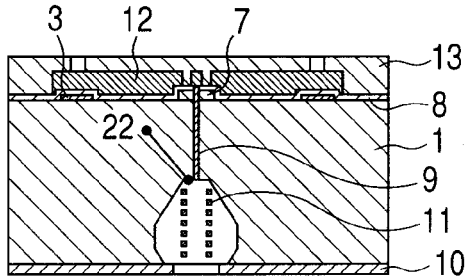
Figure 8G:
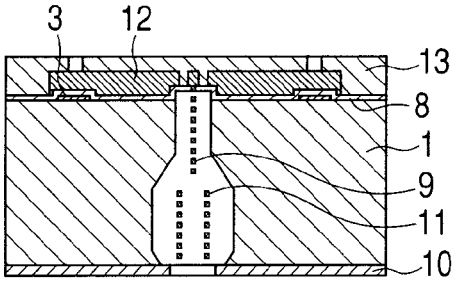
Figure 8H:
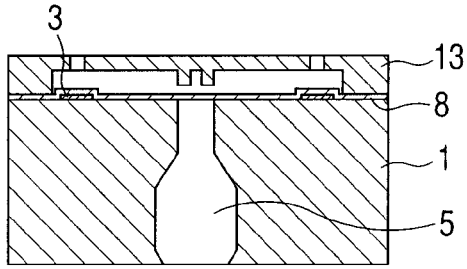

When etching further proceeds from FIG. 8E, a <100> plane 22 is formed between two leading holes 11. This <100> plane 22 communicates with the leading holes 9 of the front face of the silicon substrate 1 toward the front face of the silicon substrate 1, as etching progresses. Then, the sacrificial layer 7 comes into contact with an etching solution and is etched, and then the sacrificial layer 7 is completely etched as shown in FIG. 8G. The time for the anisotropic etching is about 5 hours. Additionally, it is possible to form the maximum opening width of the liquid supply ports 5 additionally shown in FIG. 8H with 300 μm. In addition, it is also possible to perform etching in a state where there is no etching sacrificial layer 7. Thereafter, the substrate for a liquid discharge head is completed by removing the etching stop layer 12 and the organic film etching mask 10.

As described above, according to the method of manufacturing a substrate for a liquid discharge head in the present embodiment, it is possible to reduce occurrence of defects having a size corresponding to opening width in the front face of the silicon substrate 1 caused by the influence of depth variation in the leading holes, and it is possible to provide a substrate for a liquid discharge head with a narrow liquid supply port width.

Additionally, since an etching solution enters the insides of the leading holes, it is possible to form the supply ports with etching time which is shorter compared to a case where there are no leading holes, or a case where the leading holes are provided on one side.

Moreover, in the method of manufacturing a substrate for a liquid discharge head in the present embodiment, the opening for obtaining the shape of the liquid supply ports 5 shown in FIG. 3 are formed by hole drilling with a laser. It is possible to precisely perform the laser processing to arbitrary positions and at high speed, and this does not require preceding steps for formation of a pattern (such as formation of a mask). For this reason, it is possible to obtain the liquid supply ports 5 with fewer steps.

(Comparative Configuration)

A configuration in which, the leading holes 9 at the front face are not provided in the second embodiment, but others are performed similarly to Embodiment 2 is referred to as a comparative configuration. In a substrate for a liquid discharge head according to the comparative configuration, the time of the anisotropic etching is 16 hours, and the opening width is 1000 μm.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-202735, filed Sep. 2, 2009, which is hereby incorporated by reference herein in its entirety.

The invention claimed is:

1. A method of manufacturing a substrate for a liquid discharge head including a first face, energy generating elements which generate the energy to be used to discharge a liquid to a second face opposite to the first face, and liquid supply ports for supplying the liquid to the energy generating elements, the method comprising the steps of:

preparing a silicon substrate having, at the first face, an etching mask layer having an opening corresponding to a portion where the liquid supply ports are to be formed and having first recesses provided within the opening of the etching mask layer, and second recesses provided in the region of the second face where the liquid supply ports are to be formed, the first recesses and the second recesses being separated from each other by a portion of the substrate; and etching the silicon substrate by crystal anisotropic etching from the opening of the first face to form the liquid supply ports, wherein T is defined as the thickness of the silicon substrate, X is defined as the depth of the first recesses, Y is defined as the depth of the second recesses, and the following relationship is satisfied:

$$X+Y>T.$$

2. The method of manufacturing a substrate for a liquid discharge head according to claim 1, wherein the second recesses are arrayed and provided in at least one row along a longitudinal direction of the opening, and the first recesses are arrayed and provided in at least two rows along the longitudinal direction of the opening.

3. The method of manufacturing a substrate for a liquid discharge head according to claim 2, wherein the first recesses are arranged symmetrically with respect to a centerline extending in the longitudinal direction of the opening.

4. The method of manufacturing a substrate for a liquid discharge head according to claim 2, wherein the second recesses are provided between the first recesses in a lateral direction of the opening.

5. The method of manufacturing a substrate for a liquid discharge head according to claim 1, wherein the second recesses are arrayed and provided in at least two rows in a longitudinal direction of the opening, and the first recesses are arrayed and provided in at least one row in the longitudinal direction of the opening.

6. The method of manufacturing a substrate for a liquid discharge head according to claim 5, wherein the second recesses are arranged symmetrically with respect to a centerline extending in the longitudinal direction of the opening.

7. The method of manufacturing a substrate for a liquid discharge head according to claim 5, wherein the first recesses are provided between the second recesses in a lateral direction of the opening.

8. The method of manufacturing a substrate for a liquid discharge head according to claim 1, wherein the second recesses are arrayed and provided in at least one row in a longitudinal direction of the opening, and the first recesses are arrayed and provided in at least one row in the longitudinal direction of the opening.

9. The method of manufacturing a substrate for a liquid discharge head according to claim 1, wherein a removable inorganic film is provided on the second face so as to cover the second recesses.

10. The method of manufacturing a substrate for a liquid discharge head according to claim 1, wherein a removable organic film is provided on the second face so as to cover the second recesses.

11. The method of manufacturing a substrate for a liquid discharge head according to claim 1, wherein before the etching is performed, a sacrificial layer formed from a material of which the etching speed at which the etching is performed is faster than silicon is provided in the region where the liquid supply ports are to be formed in the second face of the silicon substrate.

12. The method of manufacturing a substrate for a liquid discharge head according to claim 11, wherein a passivation layer which has etching resistance is formed so as to cover the sacrificial layer.

13. The method of manufacturing a substrate for a liquid discharge head according to claim 11, wherein, in the preparing of the silicon substrate, a laser beam passes through the sacrificial layer, and the laser beam is radiated on the silicon substrate so that the second recesses are formed in the second face.

14. The method of manufacturing a substrate for a liquid discharge head according to claim 1, wherein a passivation layer is formed in the second face and the second recesses penetrate the passivation layer.

* * * * *